US009253835B2

(12) United States Patent
Bakk

(10) Patent No.: US 9,253,835 B2
(45) Date of Patent: Feb. 2, 2016

(54) LED DIMMING MODULE

(75) Inventor: Istvan Bakk, Törökbalint (HU)

(73) Assignee: Tridonic Jennersdorf GmbH, Jennersdorf (AT)

( * ) Notice: Subject to any disclaimer, the term of this patent is extended or adjusted under 35 U.S.C. 154(b) by 0 days.

(21) Appl. No.: 14/113,532

(22) PCT Filed: Apr. 23, 2012

(86) PCT No.: PCT/EP2012/057351
§ 371 (c)(1),
(2), (4) Date: Oct. 24, 2013

(87) PCT Pub. No.: WO2012/146554
PCT Pub. Date: Nov. 1, 2012

(65) Prior Publication Data

US 2014/0049172 A1 Feb. 20, 2014

(30) Foreign Application Priority Data

Apr. 29, 2011 (DE) ..... 10 2011 017 820
Jan. 19, 2012 (DE) ..... 10 2012 200 711

(51) Int. Cl.
*H05B 33/08* (2006.01)
*G09G 3/14* (2006.01)
*G09G 5/02* (2006.01)

(52) U.S. Cl.
CPC ..... *H05B 33/0821* (2013.01); *G09G 3/14* (2013.01); *G09G 5/02* (2013.01); *H05B 33/0818* (2013.01); *H05B 33/0863* (2013.01); *H05B 33/0869* (2013.01)

(58) Field of Classification Search
CPC ..... H05B 33/0815; H05B 33/0827; H05B 33/0857; H05B 33/0833; H05B 33/0842; H05B 37/0218; H05B 37/02; G09G 2320/0666
USPC ..... 315/84, 151, 161, 186, 192, 193, 291, 315/294, 297, 231, 307
See application file for complete search history.

(56) References Cited

U.S. PATENT DOCUMENTS 7,213,940 B1 * 5/2007 Van De Ven et al. ..... 362/231
8,436,556 B2 * 5/2013 Eisele et al. ..... 315/307
(Continued)

FOREIGN PATENT DOCUMENTS

WO 2010016002 A2 2/2010

OTHER PUBLICATIONS

International Search Report issued in connection with the corresponding International Application No. PCT/EP2012/057351 on Aug. 8, 2012.

*Primary Examiner* — Vibol Tan
(74) *Attorney, Agent, or Firm* — The H.T. Than Law Group

(57) ABSTRACT

The present invention proposes an LED dimming module (10) comprising two LED strings (1,2), the first LED string (1) comprising at least one color converted blue or UV LED (1*a*) and the second LED string (2) comprising at least one amber light emitting LED (2*a*), the LED module further comprising control means (3) connected to the first and second LED string (1,2), said control means (3) being designed to selectively vary a current provided to the first LED string (1) such that a non-linear dimming curve (13*b*) of the resulting emitted light is obtained, said dimming curve (13*b*) approaching the planckian curve (9) on the CIE chromaticity diagram.

24 Claims, 4 Drawing Sheets

(56) References Cited

U.S. PATENT DOCUMENTS

| | | | | |
|---|---|---|---|---|
| 8,760,074 | B2 * | 6/2014 | Raj et al. | 315/291 |
| 8,783,901 | B2 * | 7/2014 | Zoorob et al. | 362/230 |
| 8,836,243 | B2 * | 9/2014 | Eisele et al. | 315/307 |
| 2008/0019147 | A1 * | 1/2008 | Erchak et al. | 362/607 |
| 2008/0224631 | A1 | 9/2008 | Melanson | |
| 2011/0043137 | A1 | 2/2011 | Negley et al. | |
| 2012/0001555 | A1 * | 1/2012 | Tu et al. | 315/161 |
| 2012/0119658 | A1 * | 5/2012 | McDaniel | 315/151 |
| 2012/0134148 | A1 | 5/2012 | Ter Weeme et al. | |
| 2012/0200229 | A1 * | 8/2012 | Kunst et al. | 315/186 |
| 2013/0002167 | A1 * | 1/2013 | Van de Ven | 315/297 |
| 2013/0207559 | A1 * | 8/2013 | Ferrier | 315/192 |

* cited by examiner

LED DIMMING MODULE

BACKGROUND OF THE INVENTION

The present invention relates to a light emitting diode (LED) module with enhanced dimming properties. In particular, the present invention relates to a LED module comprising two LED strings that are designed to be controlled independently such that a dimming curve of the resulting emitted light is obtained which approaches a planckian dimming curve. The present invention further relates to a lamp comprising such a dimming module.

Incandescent light sources when dimmed, e.g. from 100% to 5% of their intensity, change their color temperature from about 2700K to 1900K. Thereby, the resulting dimming curve of the emitted light ideally follows the planckian curve in the CIE chromaticity diagram as shown by curve 7*a* in FIGS. 2*a* and 2*b*.

LED lighting devices comprising a wide variety of LEDs or LED modules are well-known in the prior art. Also, dimmable LED devices are known in which the current provided to the LED is varied in order to adjust the intensity of the light emitted by the LEDs of the module. In general, this is obtained by providing a pulse width modulated driving current to the LED to be dimmed.

Changing the color temperature of the light emitted by such a LED lighting device is generally addressed by RGB or similar three to four channel solutions. Thereby, such a lighting device comprises at least three to four LED strings, each comprising different monochromatic LEDs of respectively red, green and blue color, said LEDs being provided with different driving currents.

These solutions however need a sophisticated control respectively driving unit such as for example a several channel pulse width modulation microcontroller.

DE 10 2004 047 766 A1 for example relates to such a RGB lighting device with at least four LED modules, whereby the light of at least two of the four LED modules is suitable for being mixed to white light. Thereby, LEDs of the different LED modules have peak wavelengths of between 455 to 485 nm, 512 to 538 nm, 580 to 594 nm and 608 to 626 nm respectively. A provided control unit is designed for dimming of at least three of the four LED modules. By means of the lighting device white light with a desired correlated color temperature and a high color rendering index is provided.

EP 1 462 711 A1 relates to a white LED that can be modified to freely set a color temperature as well as to improve a color rendering property. Thereby, a correction-color LED or LEDs having a peak wavelength in a specific wavelength region in association with a white LED are provided to make a color temperature-regulable LED which permit the correction of not only a color temperature but also a color rendering property by means of color-mixture of the correction-color LED and the white LED considering the color temperature and a spectrum distribution of the white LED. The color temperature-regulable LED is especially useful as a shadowless operating light, a living room light and a decorative light.

SUMMARY OF THE INVENTION

The above-outlined problem is addressed by means of the solution according to the independent claims. The present invention further aims at other objects and particularly the solution to other problems as will appear in the rest of the present description.

In a first aspect, the present invention proposes an LED dimming module comprising two LED strings, the first LED string comprising at least one color converted blue or UV LED and the second LED string comprising at least one amber light emitting LED, the LED module further comprising control means connected to the first and second LED string, said control means being designed to selectively vary a current provided to the first LED string such that a dimming curve of the resulting emitted light is obtained, said dimming curve approaching the planckian curve on the CIE chromaticity diagram.

In a second aspect, the present invention proposes an LED dimming module comprising two LED strings, the first LED string comprising at least one color converted blue or UV LED and the second LED string comprising at least one red light emitting LED and at least one green light emitting LED, the LED module further comprising control means connected to the first and second LED string, said control means being designed to selectively vary a current provided to the first LED string such that a dimming curve of the resulting emitted light is obtained, said dimming curve approaching the planckian curve on the CIE chromaticity diagram.

The obtained dimming curve on the CIE chromaticity diagram is preferably non-linear.

In a preferred embodiment, the control means are designed to provide a constant current to the second LED string.

According to the invention, two different strings of LEDs are provided which are connected to the control unit, whereby preferably only one of the two LED strings is provided with a varying driving current. Hence, by contrast to the very complex RGB arrangement of the prior art for which a sophisticated microcontroller is necessary, the present invention addresses the problem by providing two strings of LEDs and thus by providing preferably only one or two independently controlled channels respectively driving current signals.

In another preferred embodiment, the control means are designed to provide a current proportional to the current provided to the first LED string or, alternatively, a freely variable current to the second LED string.

In particular, the control means may be designed to provide a current to the second LED string which is dependent on respectively which is a function of the current provided to the first LED string.

In another preferred embodiment, the current change provided to the second LED string is preferable proportional to the current change provided to the first LED string during the dimming operation.

Thereby, the current change provided to the second LED string is preferably a function of, respectively in a predefined ratio to, the current change provided to the first LED string during dimming. In a particular preferred embodiment, the current change provided to the second LED string is preferably 15-25%, more preferably 20%, of the current change provided to the first LED string.

For example, in case of the current change being dependent on each other by 20% respectively in a ratio of 1:5 as outlined above, when the first LED string is dimmed from 100% to 50% of the provided current, the second LED string is dimmed from 100% to 90%. In case the current to the first LED string is dimmed from 100% to 10%, the current provided to the second LED string is dimmed from 100% to 82% of the originally provided current.

According to the invention, a two-channel control unit is provided which enables the LED module to emit light of a desired correlated color temperature. Thereby, the resulting emitted light preferably lies between 1500 and 7000K, more preferably between 1500 and 6500K.

The first string of the LED module comprises at least one blue LED which is preferably covered by a color conversion agent and thus constitutes a white light source. Thereby, for example a YAG phosphor or any other suitable color conversion agent may be used.

The correlated color temperature of the light emitted by said LED is preferably between 1900 and 8000K, more preferably between 3000 and 7000K, even more preferably between 3500 and 6800K.

In another preferred embodiment, the white light source emits light of a color temperature between 2700 and 1900K.

The at least one amber light emitting LED of the second string may be an amber LED die, which emits light having a peak wavelength between 575 and 600 nm, preferably between 590 and 600 nm, more preferably between 592 and 597 nm.

The at least one amber light emitting LED may as well be a phosphor converted LED. Thereby, the LED may e.g. be a blue or UV LED coated with a colour converting phosphor layer. In particular, the phosphor layer may be an europium doped orthosilicate such as e.g. $(Ba,Sr,Ca)_2SiO_4:Eu^{2+}$ (BOSE), which has a peak wavelength preferably between 590 and 600 nm, more preferably at 593 nm.

Alternatively, the phosphor layer may be a SiAlON phosphor having a peak wavelength at 560 to 590 nm.

In a preferred embodiment of the invention, the resulting spectrum of the LED module is white light having a correlated color temperature between 6500 and 3000K for the at least one amber light emitting LED of the second string emitting a peak wavelength between 580-585 nm.

In another preferred embodiment, the resulting spectrum of the LED module is white light having a correlated color temperature between 3000 and 1500K, preferably between 2700 and 1900K for the at least one amber light emitting LED of the second string emitting a peak wavelength between 590-595 nm.

The at least one red light emitting LED of the second LED string emits light having a peak wavelength between 600 and 650 nm, preferably between 610 and 630 nm.

The at least one green light emitting LED of the second LED string emits light having a peak wavelength between 500 and 570 nm, preferably between 520 and 540 nm.

The at least one red light emitting LED and/or the at least one green light emitting LED may be a red light emitting LED respectively a green light emitting LED die.

Alternatively, the at least one red light emitting LED and/or the at least one green light emitting LED may be a phosphor converted LED. Thereby, the LED may e.g. be a blue or UV LED coated with a colour converting phosphor layer. The phosphor layer may comprise a green and/or yellow emitting phosphors such as e.g. $Ce^{3+}$ doped garnets (YAG, LuAG, (YGd)AG, orthosilicates e.g. $Eu^{2+}$ doped BOSE, $CaSc_2O_4:Ce^{3+}$, $La_3Si_6N_{11}:Ce^{3+}$ and SiAlONs, such as beta and alpha SiAlONs.

The colour conversion agent may as well comprise red nitrides such as e.g. $CaAlSiN_3:Eu^{2+}$, $SrAlSiN_3:Eu^{2+}$, $(Ca,Sr)AlSiN_3:Eu^{2+}$.

In a preferred mode, the first string of the LED dimming module further comprises at least one red light emitting LED having a peak wavelength between 600 and 650 nm. Thereby, the at least one red light emitting LED of the first string is a red LED die or a phosphor converted LED.

In a further preferred mode, the second string may comprise at least one orange light emitting LED having a peak wavelength between 595 to 635 nm.

During the variation of the driving current provided by means of the first channel of the control unit to the first LED string, the driving current provided to the second LED string by means of the second channel of the control unit is preferably kept constant. The driving current to the second channel may however be as well varied. Thereby, the driving current may be controlled to be proportional to the driving current applied to the first channel as outlined above. The driving current may as well be freely controlled, independently of the driving current of the first channel.

The driving current provided to the at least one amber light emitting LED respectively the at least one red and green light emitting LED of the second LED string is preferably between 300 to 400 mA, preferably 350 mA. The driving current provided to said at least one amber light emitting LED respectively the at least one red and green light emitting LEDs is preferably the operating current of the LED and thus the current at which the LED emits its maximum light intensity.

The driving current provided to the at least one blue or UV LED of the first LED string is preferably between 10 and 400 mA. Thereby, the intensity of the light emitted by said LED is directly adjustable by means of the provided driving current.

The operating current of the at least one blue or UV LED of the first LED string and thus the current at which the LED emits its maximum light intensity lies between 0 and 750 mA, preferably between 300 to 400 mA, preferably 350 mA.

The control means of the LED module are preferably designed to vary the driving current provided to the first LED string between 5 and 100% of the operating current of the at least one color converted blue or UV LED.

The variation of the driving current of the at least one blue or UV LED of the first LED string is preferably obtained by means of pulse width modulation.

The operating current of the at least one amber light emitting LED, respectively of the at least one red light emitting LED and the at least one green light emitting LED of the second string is between 50 to 700 mA, preferably between 300 and 400 mA, more preferably 350 mA.

According to the invention, different predefined color temperatures of the emitted light are obtainable by means of the advantageous two-channel solution of the LED module. In particular, the planckian dimming of an incandescent light source is mimicked. Thereby, the complexity of the control unit of the LED module is effectively minimized.

Preferably, the dimming curve obtainable by the arrangement according to the invention approaches the planckian dimming curve on the CIE chromaticity diagram that is obtained when an incandescent light source is dimmed. Thereby, the deviation of the resulting dimming curve of the emitted light during varying of the driving current of the at least one LED of the first LED string from the planckian dimming curve is preferably minimized.

In particular, the dimming curve of the resulting emitted light of the dimming module preferably deviates from the planckian dimming curve on the CIE chromaticity diagram for each x-value of the planckian curve by less than y=+/−0.02, more preferably by less than y=+/−0.01 from the corresponding y-value of the planckian curve.

In another preferred embodiment, the dimming curve of the resulting emitted light of the dimming module deviates from the planckian dimming curve on the CIE chromaticity diagram for each x-value of the planckian curve by less than y=−0.02, more preferably by less than y=−0.01 from the corresponding y-value of the planckian curve.

In a further aspect, the present invention relates to a two-channel light engine comprising a LED dimming module as outlined above, the light engine being designed to emit light of a predefined correlated color temperature which preferably lies between 6500 and 1500K.

Accordingly, a two-channel light engine is proposed having a first channel with at least one color converted blue die, and a second channel having at least one amber light emitting LED or at least one red and one green light emitting LED. Thereby, the color point of the light engine can be set by controlling the light intensities of the two channels.

The two-channels of the LED light engine are preferably designed to be controlled independently e.g. by means of dedicated control means. In a preferred embodiment, the light engine is designed to provide a constant driving current to one of the channels, whereby the driving current provided to the other one of said two channels is selectively varied.

In a preferred embodiment, when the first and second LED strings are operated at 100% of the operating current of the respective LEDs connected to said strings, a resulting warm white light of a correlated color temperature between 2650 and 2750K, preferably about 2700K is emitted.

In another aspect, the present invention relates to a retrofit LED bulb comprising an LED dimming module as outlined above.

The retrofit LED bulb further comprises driving means for providing current to the respective LEDS of the LED dimming module. The driving means are preferably designed to be controllable by a dimmer connected to the LED bulb.

The retrofit LED bulb is designed to be inserted into the housing of existing fluorescent lighting fixtures acting as a direct replacement light unit for the fluorescent lamps of the original equipment. Accordingly, the retrofit LED bulb with the integral dimming module is able to replace existing fluorescent lamps without any need to remove the installed ballasts or make modifications to the internal wiring of the already installed fluorescent lighting fixtures.

In a further aspect, the present invention relates to a method for controlling an LED dimming module comprising a first and a second LED string, each of the LED strings comprising at least one LED, the method comprising the steps of providing a current to the at least one LED of the second string, selectively providing a variable current to the at least one LED of the first string, wherein said varying current lies between 5% to 100% of the operating current of the at least one LED of the first string such that a dimming curve of the resulting emitted light of the LED dimming module is obtained, said dimming curve approaching the planckian curve on the CIE chromaticity diagram.

Preferably, constant, proportional or freely variable current is provided to the at least one LED of the second string.

Thereby, the resulting dimming curve in the CIE chromaticity diagram is preferably non-linear.

In a preferred embodiment, the at least one LED of the first string is a phosphor coated UV or blue LED and the at least one LED of the second string is an amber light emitting LED.

In another preferred mode, the at least one LED of the first string is a phosphor coated UV or blue LED and the second LED string comprises at least one red light emitting LED and at least one green light emitting LED.

The at least one LED of the first LED string and/or the at least one LED of the second string is/are preferably operated by means of a pulse width modulation in response to a provided control signal.

Thereby, the operating current of the at least one LED of the first string is between 0 and 700 mA, preferably between 300 to 400 mA, and more preferably 350 mA.

The current provided to the second string is preferably 100% of the operating current of the at least one LED of said second string. The operating current of said at least one LED in the second string is between 50 and 700 mA, preferably between 300 to 400 mA, and more preferably 350 mA.

The current provided to the first and second control string respectively to the first and second channel of a control unit is preferably controlled in response to an input signal of a control unit and/or in response to a digital signal, e.g. according to the DALI standard.

In a preferred embodiment, the method according to the invention further comprises the steps of changing the color temperature of the emitted light of the LED module between 6500 and 3000K, more preferably between 4000K and 1000K, whereby the second channel respectively the second string of the LED module having at least one amber light emitting LED emits a light of a peak wavelength of between 580 and 585 nm.

In a further preferred embodiment, the method according to the invention further comprises the steps of changing the color temperature of the emitted light of the LED module between 3000 and 1500K, more preferably between 2700 and 1500K, even more preferably between 2700 and 2000K, whereby the second channel respectively the second string of the LED module having at least one amber light emitting LED emits a light of a peak wavelength of between 590 and 595 nm.

Hence, a close to planckian dimming curve is obtained by the embodiment according to the present invention without the need of providing a sophisticated and complex control unit. Instead, the advantageous embodiment according to the invention enables the provision of dimming curve of the emitted light between a color temperature between 1500 and 7000K, more preferably between 3000 and 6800K, even more preferably between 3500 and 6500K, by means of the provision of only a two-channel light engine, respectively by means of providing solely two LED strings which are controlled by the control means independently.

In a further aspect, the invention relates to a control unit, particularly integrated circuits such as ASIC or microcontroller (μC) that are designed for implementing a method as outlined above.

Further features, advantages and objects of the present invention will become apparent for the skilled person when reading the following detailed description of embodiments of the present invention when taken into conjunction with the figures of the enclosed drawings.

DETAILED DESCRIPTION OF THE INVENTION

Figure 1A:
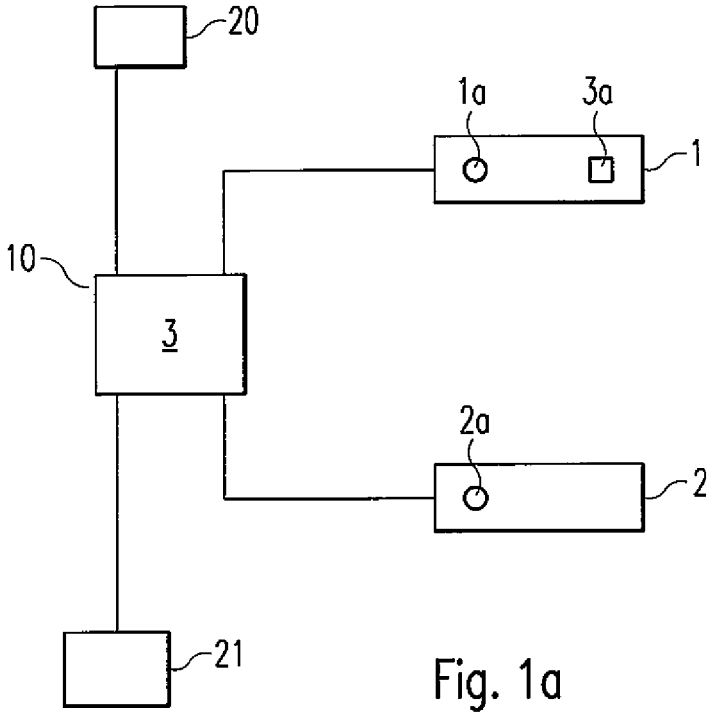
FIG. 1*a* relates to a preferred embodiment of the LED module according to the present invention.

As shown in FIG. 1, the LED module 10 according to the present invention comprises a first and a second LED string 1,2 which are connected to a control unit 3. The control unit is connected to a current supply 20.

The first LED string 1 comprises at least one phosphor coated blue or UV LED 1*a*. The string may however comprise additional blue or UV LEDs (not shown).

Optionally, the first LED string 1 preferably comprises at least one red light emitting LED 3*a* which emits light of a peak wavelength between 600 and 650 nm.

Further, the first LED string 1 may as well additionally comprise at least one orange light emitting LED (not shown) which emits light of a peak wavelength between 595 and 635 nm.

The second LED string 2 comprises at least one amber light emitting LED 2*a*. The string may comprise additional amber light emitting LEDs (not shown).

The respective LEDs 1*a*,2*a*,3*a* of the first and second LED strings 1,2 are preferably independently dimmable by means of the control unit 3 connected to the strings 1,2 and designed for carrying out a pulse width modulation of the provided driving current of the respective LED connected to the LED strings 1,2.

In a preferred embodiment, the control unit 3 is a two-channel dimming control unit having two channels which are independently addressable e.g. by a control device 21 which is connected to the control unit 3. Thereby, each channel of the control unit 3 is connected to a respective LED string 1,2.

In a more preferred embodiment, only of the two channels, in particular the channel connected to the first LED string 1 is dimmable by means of a provided varying pulse width modulated signal of the control unit 3. The other one of said two channels to which the second LED string 2 is connected, is designed to provide a constant driving current to the second LED string 2. Said other channel to which the second LED string 2 is connected may as well be designed to provide a varying driving current to the second LED string 2.

The control device 21 may comprise a potentiometer. By means of the control device 21 a user is enabled to selectively control the correlated color temperature of the emitted light of the two LED strings 1,2 within a predefined range which is preferably between 1900 and 6800K. Hence, an infinitely variable control of the resulting mixed light of the respective LEDs 1*a*,2*a*,3*a* of the first and second LED string 1,2 is enabled. Thereby, preferably only the current provided to the first channel respectively the first LED string 1 is infinitely variable by means of the control device 21, whereby a constant current is provided to the second channel respectively the second LED string 2.

Figure 1B:
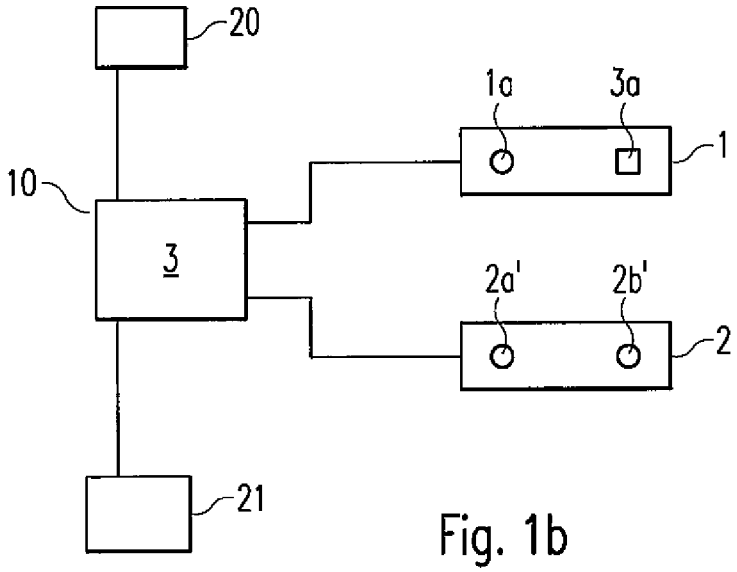
FIG. 1*b* relates to another preferred embodiment of the LED module, wherein the second string comprises at least one red and at least one green light emitting LED.

FIG. 1*b* relates to another preferred embodiment of the LED dimming module, wherein the first string 1 comprises at least one color converted blue or UV LED and the second string 2 comprises at least one red light emitting LED 2*a*' and at least one green light emitting LED 2*b*'.

The at least one red light emitting LED and/or the at least one green light emitting LED may be a red light emitting LED respectively a green light emitting LED die.

Alternatively, the at least one red light emitting LED and/or the at least one green light emitting LED may be a phosphor converted LED.

The first and second string 1,2 are preferably independently addressable by means of the control unit 3 as outlined with respect to FIG. 1*a* above.

Figure 2A:
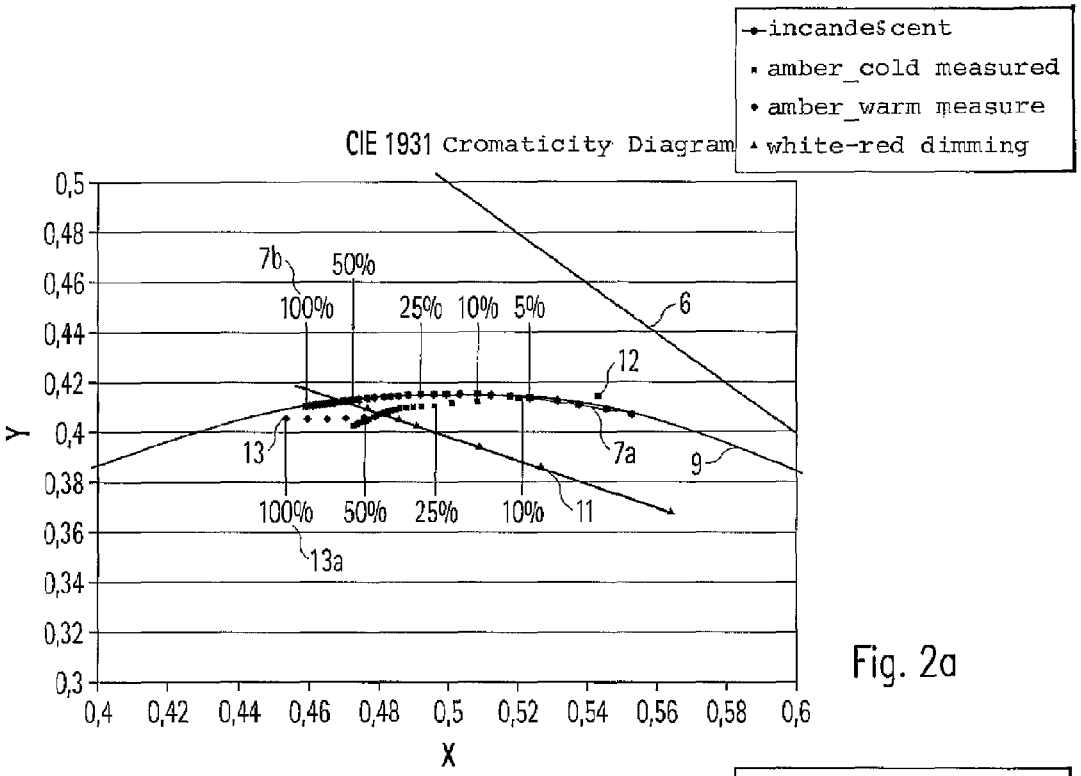
FIG. 2*a* shows a graph of the light emitted by a preferred embodiment of the LED module according to the invention on the CIE chromaticity diagram.
Figure 2B:
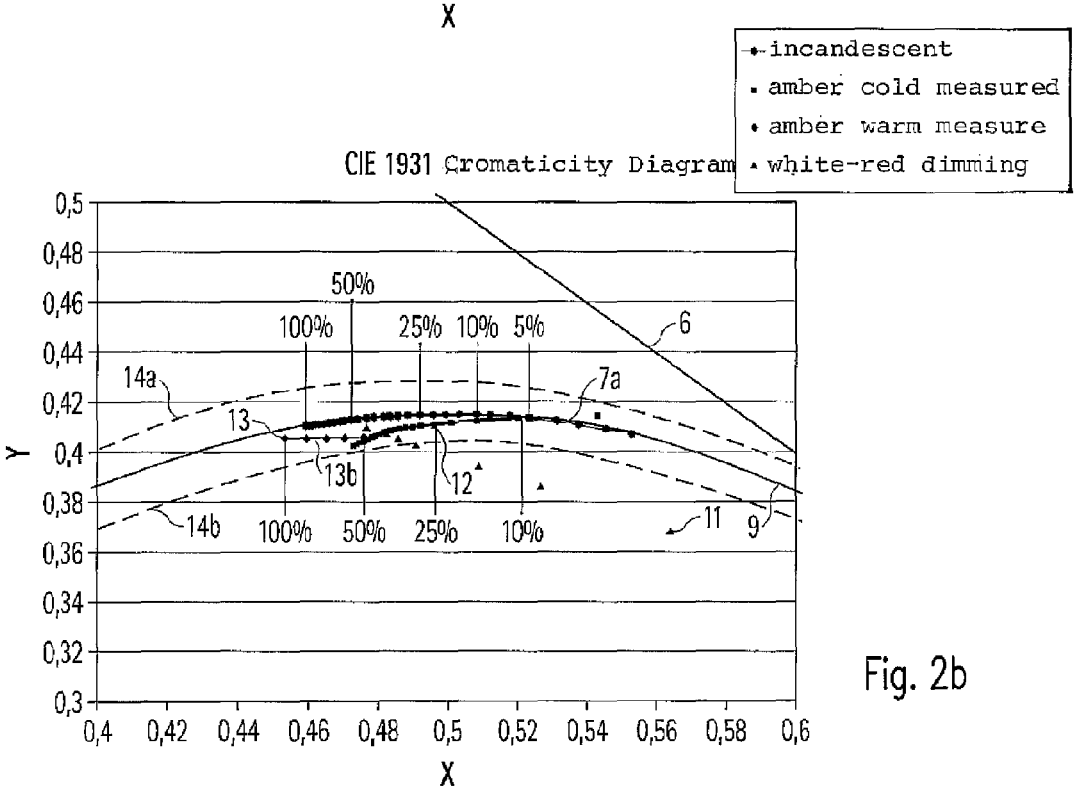
FIG. 2*b* shows the graph according to FIG. 2*a* with schematic boundaries in which the dimming curve of the light emitted by the module according to the invention lies.

FIGS. 2*a* and 2*b* show a detail of the CIE 1931 chromaticity diagram in which the planckian curve 9 is shown as well as a part of the perimeter 6 of the chromaticity diagram on which the monochromatic colors red to green are located.

An incandescent light source when dimmed from 100% to e.g. 5% of its intensity provides a dimming curve 7*a* which ideally lies on the planckian curve 9 as shown in the diagrams of FIGS. 2*a* and 2*b*. Thereby, the dots of the dimming curve 7*a* are measured color points at distinct intensity values of the incandescent light source. The percentage values 7*b* on top of the dimming curve 7*a* relate to the light intensity matching the particular color point of the curve 7*a*.

As a reference, triangles 11 in the diagram relate to a measured color points of a dimming curve obtained by providing a white LED light source in combination with a red LED source. The resulting curve 11*a* deviates to a high extent from the planckian dimming curve 9 and is therefore not desirable.

The dimming curve obtained by the LED module 10 having a first and second LED string 1,2 according to the present invention is indicated by means of the squared and diamond-shaped measure points 12,13.

The squared measure points 12 relate to a dimming curve of the LED module 10 according to the invention in a cold state of the LEDs 1*a*,1*b*.

The diamond-shaped measure points 13 relate to measured color points of a dimming curve of the LED module 10 according to the invention in a temperature stable state, i.e. in the operating state of the LEDs of the module 10. Thereby, the percentage values 13*a* shown in the diagram relate to the intensity values, in particular the values for the 100%, 50%, 25% and 10% of the intensity of the white light source 1*a* at the corresponding measured color points in the diagram in a temperature stable state of the LED module 10.

Table 1 below indicates the provided current to the first and second LED strings 1,2 comprising the at least one phosphor converted blue or UV LED (white string current) and the at least one amber light emitting LED (amber die current) according to a preferred embodiment of the LED module 10. In particular, the values indicated in table 1 correspond to the diamond-shaped measure points 13 in the diagram of FIGS. 2*a* and 2*b*.

As shown in table 1, the current provided to the second string 2 is a constant current of preferably 350 mA. The current provided to the first string 1, respectively the white string, is varied between 350 and 20 mA in order to obtain the dimming curve according to FIG. 2*a* respectively 2*b*. The light intensity of the resulting emitted light for the corresponding current values provided to the respective LED strings is indicated in the third column of table 1. When 100% of the operating current of the LEDs of the first and second string 1,2, i.e. preferably 350 mA, is provided, the resulting emitted light has preferably an intensity of between 500 and 750 lm, more preferably 636 lm.

TABLE 1

| White string current (mA) | Amber die current (mA) | Light intensity (lm) |
|---|---|---|
| 350 | 350 | 100% (636 lm) |
| 300 | 350 | 93% |
| 250 | 350 | 83% |
| 200 | 350 | 72% |

TABLE 1-continued

| White string current (mA) | Amber die current (mA) | Light intensity (lm) |
|---|---|---|
| 150 | 350 | 58% |
| 100 | 350 | 42% |
| 50 | 350 | 25% |
| 20 | 350 | 12% |

As schematically indicated in FIG. 2*b*, the deviation of the dimming curve 13*b* resulting by connecting the indicated measure points 13 at distinct color points in the CIE chromaticity diagram approaches the planckian dimming curve 9 respectively the ideal dimming curve 7*a* of an incandescent light source.

Thereby, "approaching" in the context of the present invention relates to the resulting dimming curve 13*b* following the course and/or the gradient of the planckian dimming curve 9 respectively the ideal dimming curve 7*a* of an incandescent light source.

Preferably the resulting dimming curve 13*b* in a temperature stable and/or in the cool state of the LED module deviates from the planckian dimming curve 9 to a very little extent. In this context the term "approaching" also relates to the fact that the resulting dimming curve 13*b* in the CIE chromaticity diagram deviates from the x/y-value of the corresponding closest point on the planckian curve 9 respectively the dimming curve 7*a* of an incandescent light source by a maximum y-value of about y=+/−0.02, more preferably by less than y=+/−0.015, even more preferably by less than y=+/−0.01 of the corresponding y-value.

FIG. 2*b* therefore schematically indicates boundaries 14*a*, 14*b* between which the resulting dimming curve 13*b* is preferably arranged in the CIE chromaticity diagram.

In a more preferred embodiment, the deviation in y-direction of the CIE chromaticity diagram from the closest point on the planckian curve 9 is less than y=−0.02, preferably less than y=−0.015, more preferably less than y=−0.01. Hence, the resulting dimming curve 13*b* is preferably essentially arranged between the planckian curve 9 and the schematically indicated boundary curve 14*b*.

Accordingly, a dimming curve approaching the planckian dimming curve 9 is obtainable by means of the inventive LED module 10 according to the invention. Thus, a preferably infinitely variation of the color temperature of the resulting emitted light at least within a preferred range between 2700K to 1900K is obtained.

Figure 3A:
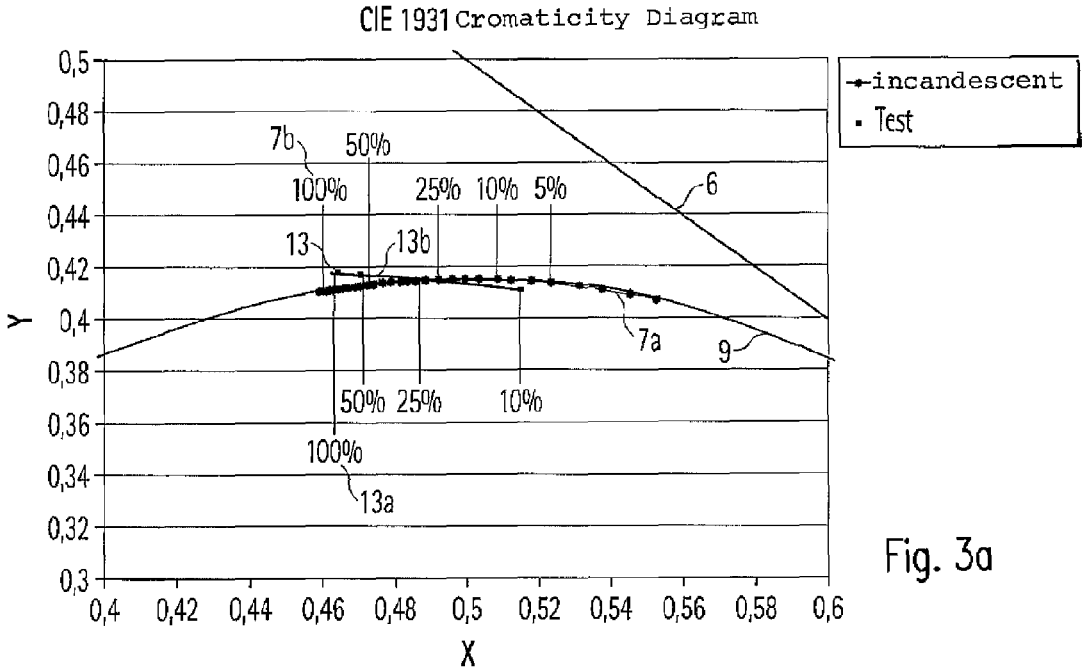
FIG. 3*a* shows a graph of the light emitted by another preferred embodiment of the LED module according to the invention on the CIE chromaticity diagram.
Figure 3B:
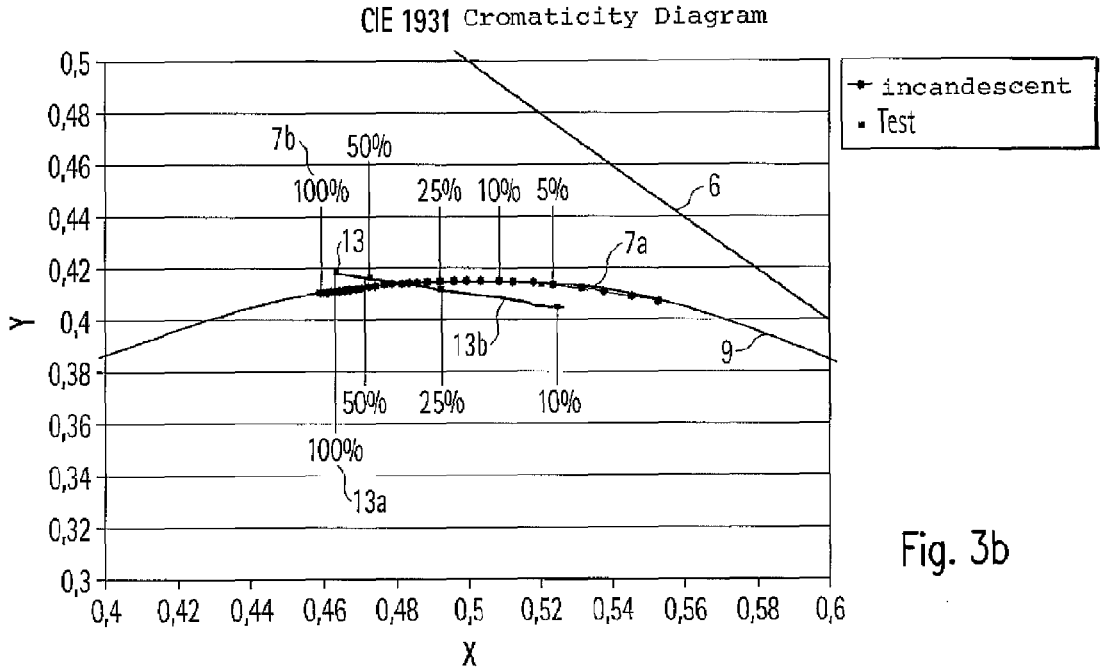
FIG. 3*b* shows a graph on the CIE chromaticity diagram of the light emitted by another preferred embodiment of the LED module.
Figure 3C:
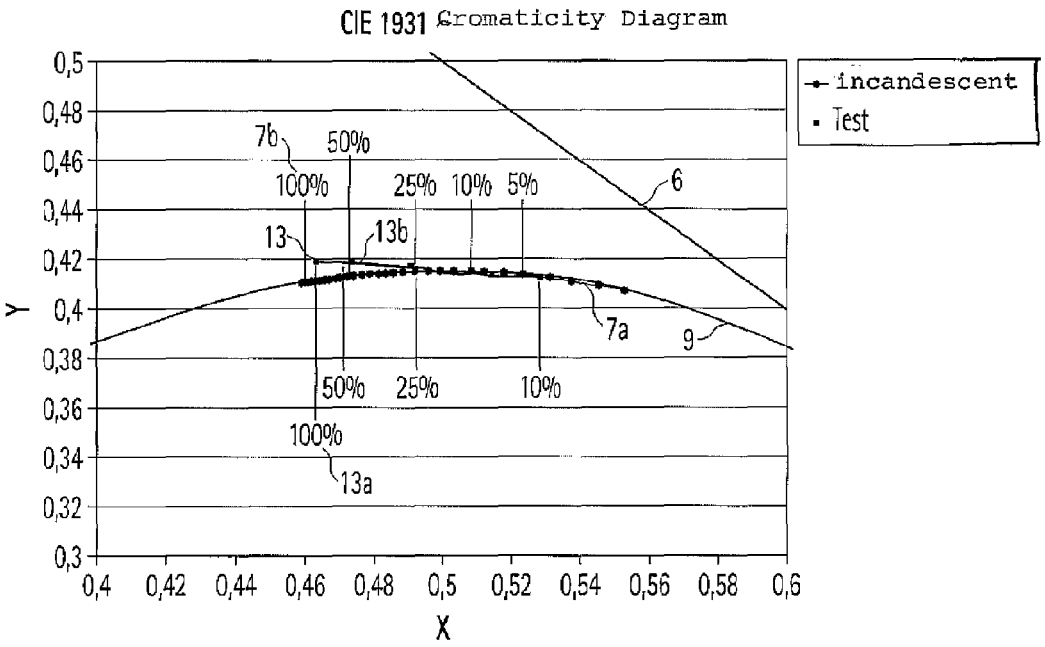
FIG. 3*c* shows a graph on the CIE chromaticity diagram of the light emitted by a further preferred embodiment of the LED module.

FIGS. 3*a* to 3*c* relate to resulting graphs on the CIE 1931 chromaticity diagram of further preferred embodiments of the dimming module according to the invention. Therein, also the incandescent dimming curve 7*a* is indicated which ideally lies on the planckian curve 9.

FIG. 3*a* shows a graph comprising measured color points 13 at distinct intensity values 13*a* of the LED module 10, wherein the first string 1 comprises a color converted blue or UV LED 1*a* and an additional red LED die 3*a*.

The blue or UV LED 1*a* is covered with a yellowish and greenish light emitting YAG phosphor. The red die has a peak wavelength of 620 m. The starting color point is at 2700K.

The second string 2 according to this embodiment comprises a red LED die 2*a*' which emits light of a peak wavelength of 630 nm and a green LED die 2*b*' emitting light of a peak wavelength of 530 nm.

As can be seen in the resulting graph 13*b*, the resulting color points 13 are very close to the planckian curve 9. Thereby, during the dimming of the LED module, the second string 2 is provided with a constant current as outlined with reference to the embodiments according to FIGS. 2*a* and 2*b*. In particular, the current to the second string 2 is controlled to be 10% of the main channel current applied by the current supply 20.

The current to the first string 1 is varied between 5% and 100% of the operating current of the LEDs 1*a*,3*a*.

FIG. 3*b* shows a graph comprising measured color points at distinct intensity values of the LED module 10, wherein the first string 1 comprises a color converted blue or UV LED 1*a* and an additional red LED die 3*a*.

The blue or UV LED 1*a* is covered with a yellowish and greenish light emitting YAG phosphor. The red die has a peak wavelength of 620 m. The starting color point is at 2700K.

The second string 2 according to this embodiment comprises an amber light emitting LED die 2*a* having a peak wavelength between 592 and 597 nm.

As can be seen in the resulting graph 13*b*, the resulting color points 13 are very close to the planckian curve 9. Thereby, during the dimming of the LED module, the second string 2 is provided with a constant current as outlined with reference to the embodiments according to FIGS. 2*a* and 2*b*. In particular, the current to the second string 2 is controlled to be 8% of the main channel current applied by the current supply 20.

The current to the first string 1 is varied between 10% and 100% of the operating current of the LEDs 1*a*,3*a*.

FIG. 3*c* shows another graph comprising measured color points 13 at distinct intensity values of the LED module 10, wherein the first string 1 comprises a color converted blue or UV LED 1*a* and an additional red LED die 3*a*.

The blue or UV LED 1*a* is covered with a yellowish and greenish light emitting YAG phosphor. The red die has a peak wavelength of 620 m.

The second string 2 according to this embodiment comprises at least one blue LED die which is covered by a BOSE phosphor. Thereby, the second string 2 comprises one blue LED die preferably covered with a BOSE phosphor mix. In particular, the blue LED may be covered with a BOSE phosphor having a peak wavelength of 593 nm and an additional BOSE phosphor having a peak wavelength of 620 nm. The two phosphors are preferably present in the BOSE phosphor mix applied to the LED in a ration of 1:5, respectively 20% BOSE 593 and 80% BOSE 620.

This is however just an example, and the particular composition of the phosphor mix as well as the individually applied phosphors of the mix may be chosen from the range of the above-outlined phosphors to be used in the present invention.

The resulting color points of this embodiment are very close to the planckian curve 9 as shown in FIG. 3*c*. With this embodiment, the colour point can be matched down to 0%.

During the dimming of the LED module, the second string 2 is provided with a constant current as outlined with reference to the embodiments according to FIGS. 2*a* and 2*b*. In particular, the power to the second string 2 is controlled to be 5-15% of the power applied to the first string 1 in a non-dimmed state. Hence, for example a power of 1000 mW is applied to the first string 1, whereby the second string 2 is provided with 50-150 mW in a non-dimmed state. In case of dimming e.g. the power of the first string 1 is dimmed to 100 mW and the power of the second string 2 is fixed to 50-150 mW.

Thereby, the current to the first string 1 is varied between 10% and 100% of the operating current of the LEDs 1*a*,3*a*.

It is to be noted that the phosphors according to the invention are preferably dispensed in a globe top or resin material covering the respective LED die. The phosphors may be as well incorporated in polymer lenses and thus be used as a remote phosphor which may be applied to the respective LED die.

Figure 4:
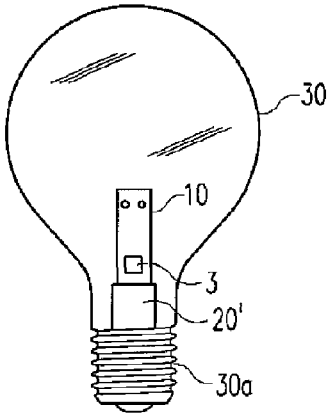
FIG. 4 relates to a retrofit LED lamp comprising an LED dimming module according to the invention.

FIG. 4 shows a schematic drawing of a retrofit LED lamp 30 according to the invention. The retrofit lamp 30 may be configured to essentially correspond to a conventional light bulb. Thereby, the lamp 30 comprises connection means 30*a* for connecting the lamp to a power supply network.

The connection means 30*a* may be an Edison screw base with standard screw threat such as for example E14, E17, E27, E40 or the like.

The retrofit LED lamp 30 comprises a LED dimming module 10 according to the invention being connected to a driving means 20' such as a current supply which is connected to the LED dimming module 10 as well as to the connection means 30*a*.

The driving means 20' are preferably designed to provide a current to the LED dimming module 10. Moreover, the driving means 20' are adapted to be controllable by a dimmer (not shown) connected to the power supply network in order to vary the current provided to the first and second strings 1,2 of the LED dimming module 10 of the LED lamp 30.

In addition, the retrofit LED lamp 30 may comprise cooling means such as a heat sink designed to enable a heat transfer away from the LED module 10.

Although the present invention has been described with reference to preferred embodiments thereof, many modifications and alternations may be made by a person having ordinary skill in the art without departing from the scope of this invention which is defined by the appended claims.

In particular, it should be understood that the particular number of LEDs in the first and second LED string 1,2 may differ from the indicated amount. Thereby, the LEDs of the first and second string 1,2 are preferably of equal amount, but may as well vary in order to enhance the light output or the particular characteristic of the resulting dimming curve of the LED module.

The invention claimed is:

1. LED dimming module (10) consisting essentially of two LED strings (1,2), the first LED string (1) comprising at least one color converted blue or UV LED (1*a*) constituting a white light source and the second LED string (2) comprising at least one amber light emitting LED (2*a*), the LED module further comprising control means (3) connected to the first and second LED string (1, 2), said control means (3) being designed to selectively vary a current provided to the first LED string (1) such that a non-linear dimming curve (13*b*) of the resulting emitted light is obtained, said dimming curve (13*b*) approaching the planckian curve (9) on the CIE chromaticity diagram.

2. LED dimming module (10) consisting essentially of two LED strings (1,2), the first LED string (1) comprising at least one color converted blue or UV LED (1*a*) constituting a white light source and the second LED string (2) comprising at least one red light emitting LED and at least one green light emitting LED, the LED module further comprising control means (3) connected to the first and second LED string (1,2), said control means (3) being designed to selectively vary a current provided to the first LED string (1) such that a non-linear dimming curve (13*b*) of the resulting emitted light is obtained, said dimming curve (13*b*) approaching the planckian curve (9) on the CIE chromaticity diagram.

3. LED dimming module according to claim 1, wherein constant, proportional or freely variable current is provided to the second LED string (2).

4. LED dimming module according to claim 1, wherein a current change provided to the second LED string (2) is a predefined ratio of the current change provided to the first LED string (1) during dimming.

5. LED dimming module according to claim 1, wherein the at least one amber light emitting LED (2*a*) emits light having a peak wavelength between 575 and 600 nm, preferably between 590 and 600 nm, more preferably between 592 and 597 nm.

6. LED dimming module according to claim 5, wherein the at least one amber light emitting LED (2*a*) is an amber LED die or a phosphor converted LED.

7. LED dimming module according to claim 1, wherein the resulting spectrum of the LED module is white light having a correlated color temperature between 6500 and 3000K for the at least one amber light emitting LED (2*a*) of the second string emitting a peak wavelength between 580-585 nm and between 3000 and 1500K for said LED (2*a*) emitting a peak wavelength between 590-595 nm.

8. LED dimming module according to claim 2, wherein the at least one red light emitting LED and/or green light emitting LED is a LED die or a phosphor converted LED.

9. LED dimming module according to claim 2, wherein the at least one red light emitting LED emits light having a peak wavelength between 600 and 650 nm, preferably between 610 and 630 nm; and the at least one green light emitting LED emits light having a peak wavelength between 500 and 570 nm, preferably between 520 and 540 nm.

10. LED dimming module according to claim 1, wherein the first string further comprises at least one red light emitting LED (3*a*) having a peak wavelength between 600 and 650 nm.

11. LED dimming module according to claim 10, wherein the at least one red light emitting LED (3*a*) is a red LED die or a phosphor converted LED.

12. LED dimming module according to claim 1, wherein green, yellow or yellowish-green emitting phosphor(s) or green, yellow or yellowish-green emitting phosphor(s) and red phosphor(s) is/are applied as color conversion material(s) in case of the at least one color converted blue or UV LED.

13. LED dimming module according to claim 1, wherein the dimming curve (13*b*) of the resulting emitted light of the dimming module deviates from the planckian dimming curve (9) on the CIE chromaticity diagram for each x-value of the planckian curve by less than y=+/−0.02, more preferably by less than y=+/−0.01 from the corresponding y-value of the planckian curve (9).

14. LED dimming module according to claim 1, wherein the operating current of the at least one blue or UV LED (1*a*) of the first string (1) is between 700-0 mA, preferably 350 mA and/or of the at least one amber LED (2*a*) of the second string (2) is between 50 to 700 mA, preferably 350 mA.

15. LED dimming module according to claim 1, wherein the control means (3) are designed to vary the current provided to the first LED string (1) between 5 and 100% of the operating current of the at least one color converted blue or UV LED (1*a*).

16. A two-channel light engine comprising a LED dimming module according to claim 1 being designed to emit light of a correlated color temperature between 4000K to 1000K.

17. A retrofit LED-bulb comprising a LED dimming module (10) according to claim 1 and a driving means (20') designed to be controllable by a dimmer.

18. A method for controlling an LED dimming module consisting essentially of a first and a second LED string (1,2), each of the LED strings comprising at least one LED (1*a*,2*a*), the method comprising the steps of providing a current to the at least one LED (2*a*) of the second string (2), selectively providing a variable current to the at least one LED (1*a*) of the first string (1), wherein said varying current lies between 5% to 100% of the operating current of the at least one LED (1*a*) of the first string (1) such that a non-linear dimming curve (13*b*) of the resulting emitted light of the LED dimming module (10) is obtained, said dimming curve (13*b*) approaching the planckian curve (9) on the CIE chromaticity diagram wherein the current provided to the second string (2) is a constant current or a current proportional to the current provided to the first LED string (1), wherein the at least one LED (1*a*) of the first string (1) is a phosphor coated UV or blue LED and wherein the at least one LED (2*a*) of the second string (2) is an amber light emitting LED, or at least one red light emitting LED and at least one green light emitting LED.

19. The method according to claim 18, wherein the current provided to the second string (2) is between 50 to 700 mA, preferably 350 mA.

20. The method according to claim 18, wherein the operating current of the at least one LED (1*a*) of the first string (1) is between 700 to 0 mA, preferably 350 mA.

21. The method according to claim 18, wherein the at least one LED (1*a*) of the first LED string (1) is operated by means of a pulse width modulation in response to a provided control signal.

22. The method according to claim 18, wherein the current provided to the first and second control string (1,2) is controlled in response to an input signal of a control unit and/or in response to a digital signal, e.g. according to the DALI standard.

23. Control unit, particularly integrated circuits such as ASIC or μC, being designed for implementing a method according to claim 18.

24. A method for controlling an LED dimming module consisting essentially of a first and a second LED string, each of the LED strings comprising at least one LED, the method comprising the steps of providing a current to the at least one LED of the second string, selectively providing a variable current to the at least one LED of the first string, wherein said varying current lies between 5% to 100% of the operating current of the at least one LED of the first string such that a non-linear dimming curve of the resulting emitted light of the LED dimming module is obtained, said dimming curve approaching the planekian curve on the CIE chromaticity diagram, wherein at least one LED of the first string is a phosphor coated UV or blue LED and wherein at least one LED of the second LED string is an amber light emitting LED, or at least one red light emitting LED and at least one green light emitting LED, wherein the current provided to the second string is a current proportional to the current provided to the first LED string, the current change provided to the second LED string being 15-25% of the current change provided to the first LED string.

* * * * *